US010692352B2

(12) United States Patent
Dougall et al.

(10) Patent No.: US 10,692,352 B2
(45) Date of Patent: Jun. 23, 2020

(54) BUOY HULL CORROSION DETECTION SYSTEM

(71) Applicant: The Government of the United States of America, as represented by the Secretary of Homeland Security, Washington, DC (US)

(72) Inventors: Michael Luis Dougall, Washington, DC (US); Jacob James Rath, Washington, DC (US); Blaise Carlson Curtis, Washington, DC (US); Liam Christian Otto, Washington, DC (US); Frederick John McClimans, Washington, DC (US); Matthew Tyler Williams, Washington, DC (US); Thomas Carsten Rodzewicz, Washington, DC (US); Ronald Adrezin, East Lyme, CT (US); Michael Plumley, Washington, DC (US)

(73) Assignee: The Government of the United States of America, as represented by the Secretary of Homeland Security, Washington, DC (US)

( * ) Notice: Subject to any disclaimer, the term of this patent is extended or adjusted under 35 U.S.C. 154(b) by 0 days.

(21) Appl. No.: 16/387,280

(22) Filed: Apr. 17, 2019

(65) Prior Publication Data

US 2020/0152045 A1 May 14, 2020

Related U.S. Application Data

(60) Provisional application No. 62/757,999, filed on Nov. 9, 2018.

(51) Int. Cl.

| | |
|---|---|
| ***G08B 21/20*** | (2006.01) |
| ***B63B 22/04*** | (2006.01) |
| *B63B 22/00* | (2006.01) |

(52) U.S. Cl.
CPC ..... *G08B 21/20* (2013.01); *B63B 22/04* (2013.01); *B63B 2022/006* (2013.01); *B63B 2203/00* (2013.01)

(58) Field of Classification Search
CPC ..... G08B 21/20; B63B 22/00; B63B 22/04; B63B 35/00; B63B 2043/006;
(Continued)

(56) References Cited

U.S. PATENT DOCUMENTS 6,325,012 B1 * 12/2001 Aristizabal ..... B63C 11/34 114/314
6,536,272 B1 * 3/2003 Houston ..... G01N 1/12 702/2

(Continued)

OTHER PUBLICATIONS

United States Coast Guard, CH-7 Aids to Navigation Manual—Technical, Comdtinst M16500.3A, Washington, D.C., Apr. 6, 2010.

*Primary Examiner* — Orlando Bousono
(74) *Attorney, Agent, or Firm* — Lavanya Ratnam; Kelly G. Hyndman; H. James Voeller

(57) ABSTRACT

A buoy corrosion detection system includes a buoy having a double hull section in which the outer hull is designed to corrode and fail prior to the rest of the hull. The double hull section is positioned at the waterline, which is the area most prone to corrosion. As the outer hull corrodes, water passes through the hull and is detected by a moisture detector. The moisture detector then relays a signal that water has entered through the hull, and a signaling circuit then sends a communication signal to the user indicating that the buoy has corrosion. The buoy corrosion detection system leads to an "as-needed" maintenance cycle for buoys.

17 Claims, 7 Drawing Sheets

(58) Field of Classification Search
CPC ..... B63B 45/00; B63B 79/00; B63B 79/10; B63B 79/15; B63B 79/30; B63C 11/42; B63G 8/001
See application file for complete search history.

(56) References Cited

U.S. PATENT DOCUMENTS

| | | | | |
|---|---|---|---|---|
| 2004/0015277 | A1* | 1/2004 | Cardoza | B63B 22/18 701/21 |
| 2004/0056779 | A1* | 3/2004 | Rast | B63B 22/16 340/985 |
| 2005/0016430 | A1* | 1/2005 | Cardoza | B63B 22/18 114/144 A |
| 2008/0141921 | A1* | 6/2008 | Hinderks | B63B 1/28 114/274 |
| 2014/0216325 | A1* | 8/2014 | Hardy | B63G 8/001 114/321 |
| 2016/0221655 | A1* | 8/2016 | Austin | B63B 22/003 |
| 2019/0100292 | A1* | 4/2019 | Austin | B63G 8/22 |

* cited by examiner

FIG. 3
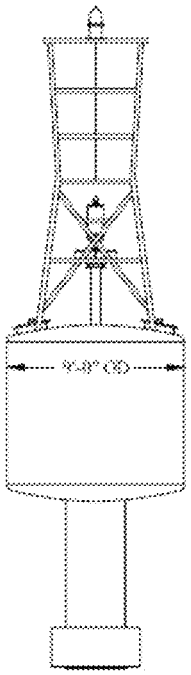
FIG. 3A
9X35LWR
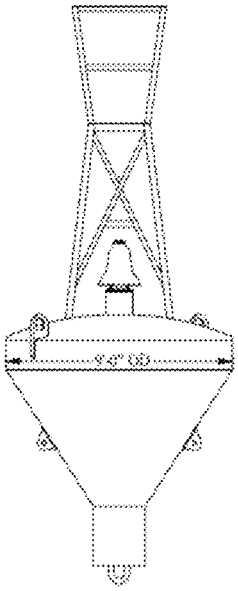
FIG. 3B
9X20BR
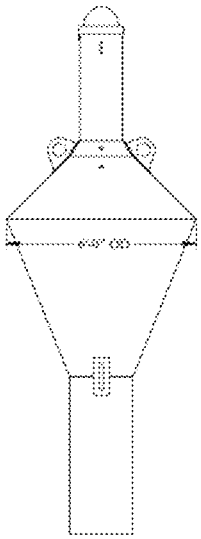
FIG. 3C
6X16L
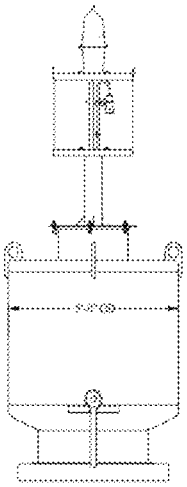
FIG. 3D
5X11LR
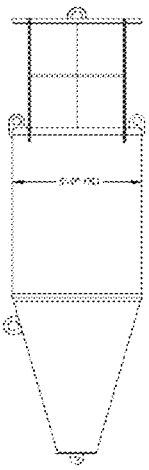
FIG. 3E
1CR FIG. 5
FIG. 5A
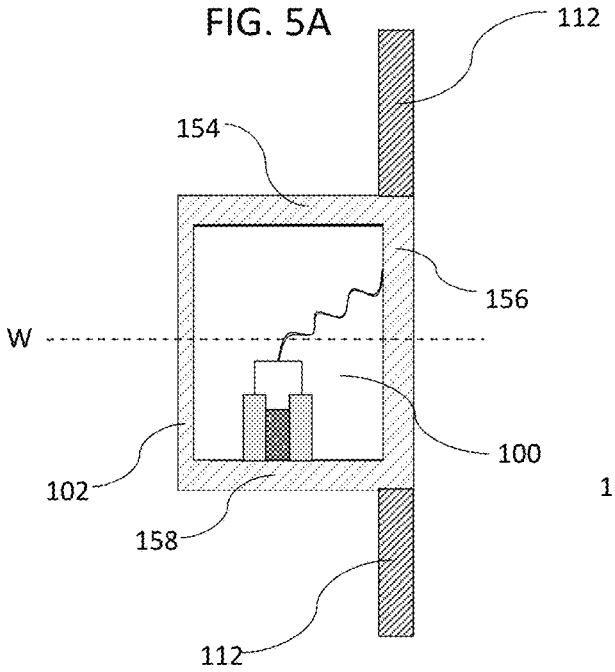
FIG. 5B
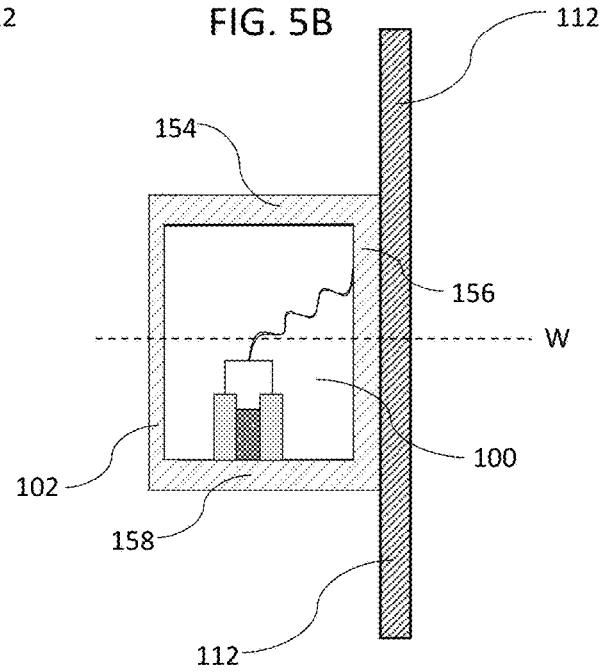
FIG. 5C
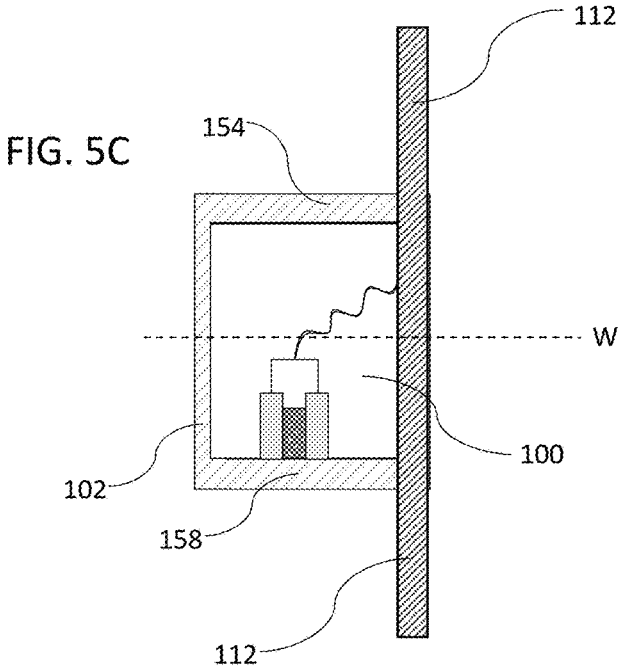

BUOY HULL CORROSION DETECTION SYSTEM

CROSS-REFERENCE TO RELATED APPLICATIONS

This application claims priority to U.S. Provisional Application 62/757,999, filed Nov. 9, 2018, which is incorporated by reference in its entirety.

GOVERNMENT INTEREST

The subject matter of this disclosure was made with support from the United States Department of Homeland Security (DHS). The Government of the United States of America has certain rights in this invention.

FIELD

The invention relates to a system for detecting corrosion to a buoy hull. The system detects and communicates the presence of corrosion so that an "as needed" maintenance cycle can be applied.

BACKGROUND

The United States marks its waters to assist mariners, mark isolated dangers, enable pilots to follow channels, and help ships pilot coastal waters. The system of marking is known as the U.S. Aids to Navigation System (AToN). AToN relies primarily on buoys and beacons as marking devices, but also employs lights, lightships, radio beacons, fog signals, and marking indicia. The marking indicia include various arrangements of colors, shapes, numbers, and light characteristics that provide additional information about navigable channels, waterways and nearby obstructions.

"Buoys" are floating objects that are anchored. Their distinctive shapes and colors communicate their purpose and how to navigate around them. "Beacons" are structures, permanently fixed to the sea-bed or land. They range in size from light houses to single-pile poles.

The United States Coast Guard (the "Coast Guard") maintains AToN and expends a great deal of resources inspecting, retrieving and overhauling buoys. Conventionally, the Coast Guard retrieves buoys for depot level maintenance at set time intervals (usually nine years).

A set interval for depot level maintenance, however, is inefficient. Buoys in different environments corrode at different rates. Many variables affect the corrosion rate, so the amount of corrosion for any given buoy over the maintenance time interval is considered unpredictable. Periodic depot level maintenance for any given buoy may be premature, timely, or too late. When the buoy needs no substantial maintenance, the depot work is premature. When the buoy is beyond repair, the work is too late. Timely buoy maintenance performed as needed would be more efficient than performing maintenance at predetermined intervals.

SUMMARY

The description below discloses an inspection and monitoring system intended for autonomously detecting oxidation and/or coating failure in buoys so that buoy maintenance can be performed as needed instead of at set time intervals.

In one embodiment, a corrosion detection system autonomously detects and monitors corrosion levels of a buoy hull.

The system incorporates a double hull section in the buoy. The double hull section has an outer hull and an inner hull. The outer hull is designed to corrode and fail prior to the rest of the buoy hull. When the outer hull of the double hull section corrodes enough to permit water to enter, the water enters a small compartment. The inner walls of the compartment are the inner hull. These inner walls have not previously been in contact with the water and are not corroded. The inner walls prevent the water from entering into the core of the buoy. Detection equipment in the compartment detects the water and communicates the need for maintenance.

According to various embodiments, the outer hull of the double hull section is of the same material as the rest of the buoy but thinner. The double hull section is in the waterline area, which is the area most prone to corrosion.

The corrosion detection system in embodiments is powered by a battery and includes a regenerative energy system to charge and recharge the battery. According to various embodiments, the regenerative energy system uses solar panels and/or the rolling motion of the buoy to charge the battery.

According to various embodiments, the corrosion detection system reports data via a communications network.

Embodiments of the present system also include methods of monitoring corrosion levels in buoys, and methods of inspecting and monitoring oxidation and/or coating failure in buoys.

BRIEF DESCRIPTION OF THE DRAWINGS

FIG. 3A-3E indicate schematics of Coast Guard buoy models 9X35LWR, 9X20BR, 6X16LI, 5X11LR and 1CR, respectively.

FIG. 5A-5C are schematic cross-section views of a double hull section of a buoy, according to embodiments of the present corrosion detection system.

DETAILED DESCRIPTION

Figure 1:
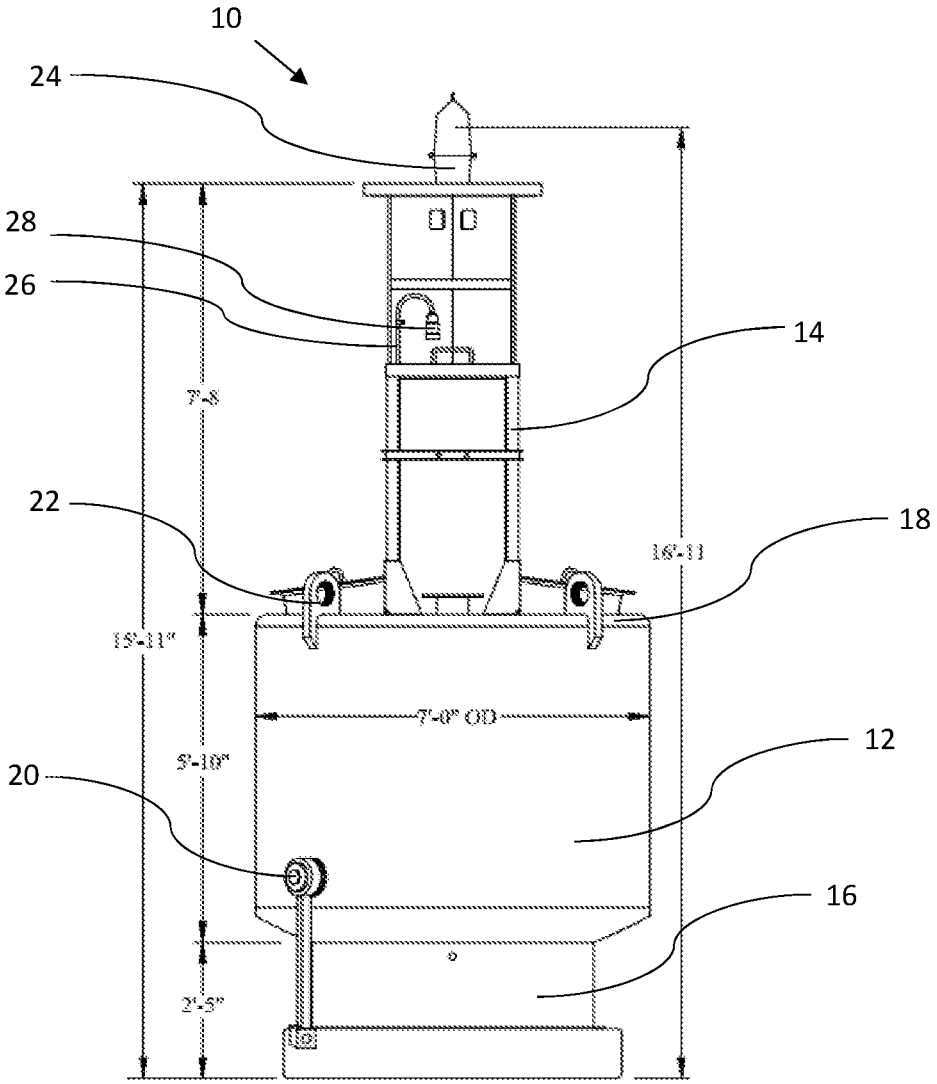
FIG. 1 is a schematic view of a marine buoy of Coast Guard buoy model 7X17 that can be utilized with an embodiment of the present corrosion detection system.

One aspect of the present disclosure relates to a corrosion detection system capable of autonomously detecting and monitoring corrosion levels of a buoy hull. The buoy has a double hull section positioned at the waterline. The double hull section has an outer hull and an inner hull. The outer hull is adapted to corrode and fail prior to the rest of the buoy hull. A moisture detection system then detects water entering through the outer hull, which indicates the presence of corrosion in the buoy, and sends a communication signal indicating the presence of corrosion.

According to various embodiments, the present corrosion detection system is incorporated into any size or type of buoy. By way of example, the Coast Guard uses a wide variety of lighted and unlighted steel, foam and plastic buoys. Lighted buoys and unlighted sound buoys are designated "pillar" buoys by the International Association of Marine Aids to Navigation and Lighthouse Authorities (IALA) due to their cage and tower arrangements.

Lighted buoys and unlighted sound buoys are classified according to diameter and length, and various design attributes.

| Lighted Buoy Attributes Designation | Attribute |
|---|---|
| L | Lighted |
| R | Radar Reflector |
| B | Bell |
| G | Gong |
| W | Whistle |
| H | Horn |
| I | Ice |
| C | Can-Shaped Radar Reflector |
| N | Nun-Shaped Radar Reflector |
| F | Foam |

Examples

An 8X26LWR is an eight foot diameter by 26 foot long lighted whistle buoy with a radar reflector.

A 5X11LNR is a five foot diameter by eleven foot long lighted buoy with a nun-shaped radar reflector.

A 9X20BR is a nine foot diameter by 20 foot long unlighted bell buoy with a radar reflector.

Unlighted buoys are identified by their shape (can or nun), class (1st through 6th, with 1st being the largest and 6th the smallest), and various design attributes.

| Unlighted Buoy Attributes Designation | Attribute |
|---|---|
| R | Radar Reflector |
| C | Can-Shaped |
| N | Nun-Shaped |
| I | Ice F Foam |
| P | Plastic |
| S | Special |
| T | Tall |
| FW | Fast Water |

Examples

A 2NFR is a second class nun made of foam with a radar reflector.

A 5NI is a fifth class nun ice buoy.

In an embodiment, the detection system is incorporated into a heavy weather buoy, such as the Coast Guard's 7X17 model buoy. Heavy weather buoys are inherently large, and for this reason are expensive to produce and overhaul. Furthermore, due to their large size, buoy tenders will typically spend more time working on them in the field than they would smaller models. The 7X17 buoys are also one of the most prevalent of the large, heavy weather buoys.

The characteristics of the 7X17 buoy can be found in the Coast Guard's AToN manual (Apr. 6, 2010). This manual is also referred to as COMDTINST M16500.3A, "Aids to Navigation Manual, Technical" available from the United States Coast Guard. Chapters 2 (Buoys and Moorings), 3 (Buoy Markings), 8 (Monitor and Control Equipment), and 9 (Power Systems) are specifically incorporated herein by this reference for their useful background information on buoy structure and markings, and also for their background information on buoy communications and power.

Illustrated in FIG. 1, a 7X17 buoy 10 has a generally hollow core 12, a tower 14, and a counterweight 16. The cylindrical core 12 has an outside diameter of 7.0 ft., and a height of 5 ft. 10 in. The hull of core 12, also referred to as the "wrapper", is steel and has a thickness of 0.25 inch. One or more batteries are inside the core 12, in a battery pocket (not shown). Tophead 18 seals the core 12.

Figure 2:
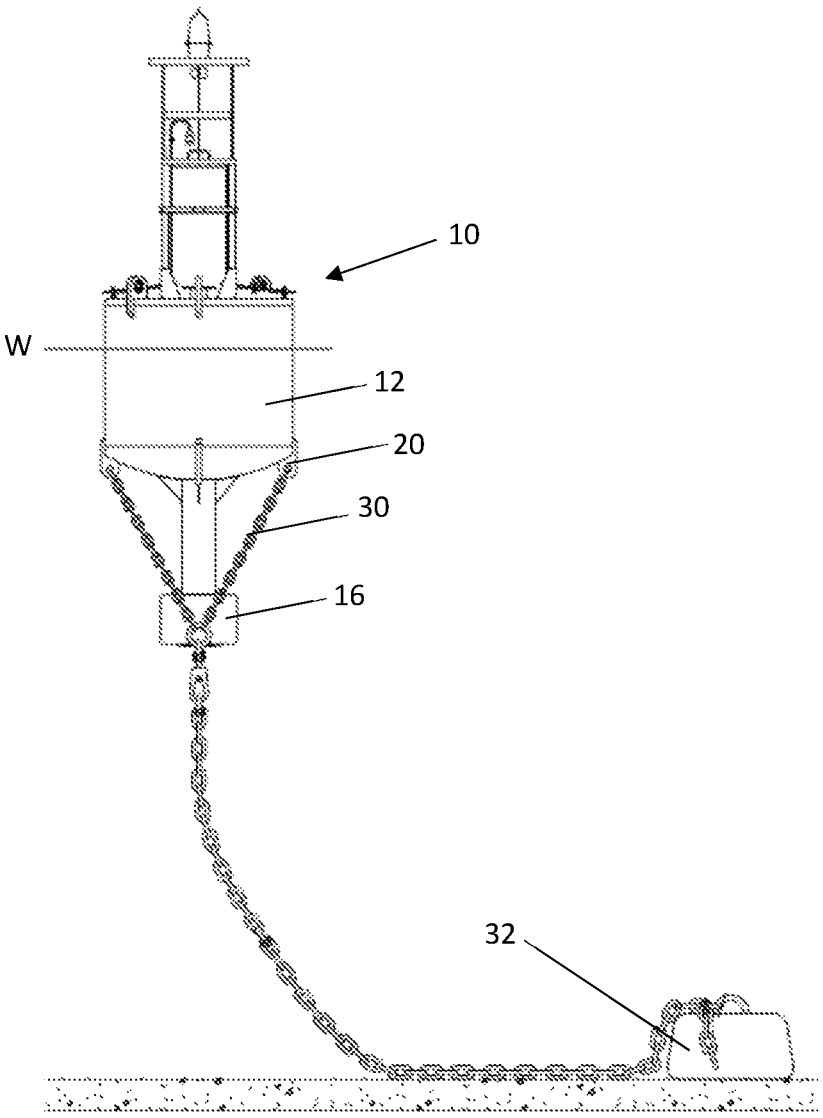
FIG. 2 is a schematic view of a deployed marine buoy anchored to the sea bottom.

Buoy 10 also features one or more mooring bails 20 for attaching the buoy to a chain 30 and sinker 32, and mooring the buoy to the bottom, as shown in FIG. 2. In general, sinker 32 is made of concrete and, in the 7X17 model, weighs about 8,500 lbs. Buoy 10 also includes one or more lifting bails 22 for attachment to a hoist and lifting/moving the buoy in and out of the water.

The tower 14 is 7 ft. 8 in. tall and includes a lantern 24 of about 12 in. mounted on top. A vent line 26 with a vent valve 28 positively ventilates the buoy battery pocket while prohibiting water from entering the vent line 26 when the buoy is submerged and/or tilted. Ventilation of the battery pocket prevents the hydrogen gas buildup often associated with lead-acid batteries.

Counterweight 16 is 2 ft. 5 in. in length and weighs about 3,100 lbs. The counterweight lowers the center of gravity of the buoy and, together with the buoyancy of the core 12, positions the buoy 10 within the water (W) at a desired level.

In use, the 7X17 buoy has a buoy draft of about 5 ft. 6 in. (distance from the water line of the buoy to its lowest underwater part, not including mooring), and a freeboard of 3 ft. (distance from the waterline to the top of the hull). The total weight of the buoy (without mooring) is about 7,800 lbs (weight of the buoy in air).

The 7X17 model buoy is just one example of a type of buoy that can benefit from a corrosion detection system. The 7X17 model buoy is described for illustration purposes. Other types of buoys that can utilize the present system are shown in FIG. 3 A-E, which schematically show Coast Guard Models 9X35LWR, 9X20BR, 6X16LI, 5X11LR and 1CR, respectively.

While corrosion can be random and hard to predict, the inventors have determined that the worst corrosion on sea buoys occurs around the water line due to fluctuating exposure to air and water (oxygen and an electrolyte). The inventors have further determined that the worst corrosion is typically localized within one foot from either side of the waterline.

According to various embodiments, a buoy has a double hull section at the waterline. To put it another way, a buoy has a compartment at the waterline with one or more exterior walls that touch the water, and one or more interior walls that do not touch the water until water enters the compartment; the portions in contact with the water are part of the outer hull and the portions that do not touch the water define an inner hull. Together, the exterior walls and the interior walls form a double hull section. The outer hull (i.e., the one or more exterior walls) of the double hull is designed to fail prior to the rest of the buoy hull. When water penetrates the outer hull, a moisture detection system will recognize water is present and signal that enough corrosion has occurred to the buoy hull to warrant maintenance.

According to various embodiments, the buoy has a double hull section in which the outer hull or exterior wall is thinner than the hull on the rest of the core. This double hull section is placed a predetermined distance above and below the waterline, which targets the area most prone to corrosion. In various embodiments, the double hull section is positioned in a range of about 0.5-2 feet above and about 0.5-2 feet below the waterline, or about 1.5 feet above and about 1.5 feet below, or about 1 foot above and 1 foot below, or about 0.5 feet above and 0.5 feet below the waterline.

Figure 4:
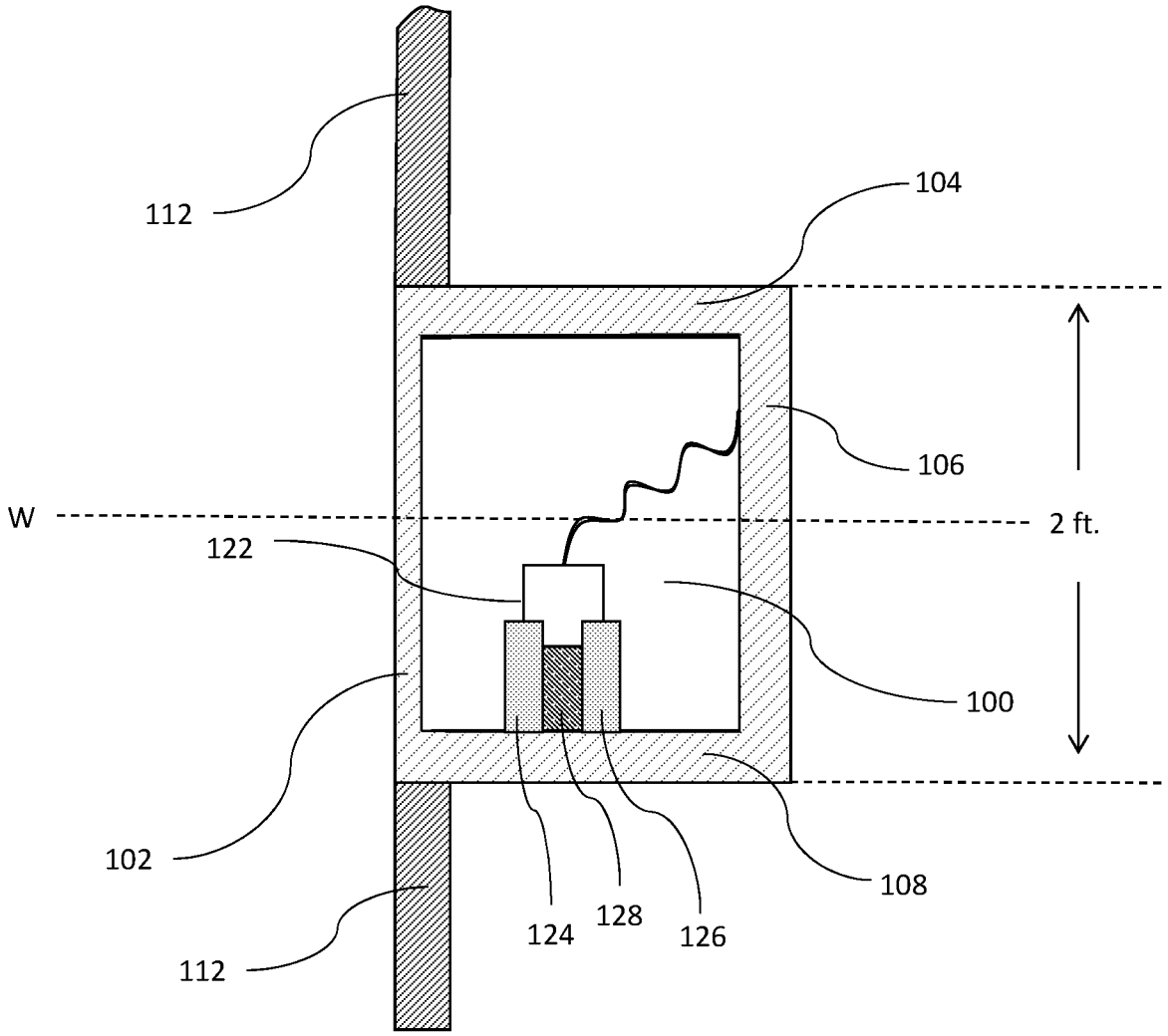
FIG. 4 is a schematic cross-section of a double hull section of a buoy, according to an embodiment of the present corrosion detection system.

According to an embodiment, illustrated in FIG. 4, the buoy hull is cut, and a compartment 100 is installed in or on the buoy hull. This structure, in an embodiment, is hollow and box-shaped with a rectangular cross-section. In the embodiment in FIG. 4, the compartment 100 is centered at the waterline W, and has a length of about 2 feet such that 1 foot of the compartment lies above the waterline and 1 foot lies below the waterline. In an embodiment, the exterior wall 102 of compartment 100 (i.e., the one or more outer sides) is flush with the exterior of the buoy hull 112 and the other walls (i.e., the one or more inner sides) are inside the buoy hull 112.

The exterior wall 102 of compartment 100 is thinner than that of the buoy hull 112. According to various embodiments, the buoy hull has a thickness of about 0.25 in., and the thickness of the exterior wall 102 is about one-half, or about 0.125 in. The remaining sides 104, 106 and 108 of compartment 100 are not thinner and have at least about the same thickness as that of the buoy hull (e.g., 0.25 in.).

The thickness of exterior wall 102 of compartment 100 can be in a range of about 0.9 to 0.1 times the thickness of the buoy hull, about 0.8 to 0.2 times, about 0.7 to 0.3 times, about 0.6 to 0.4 times, or about 0.5 times the thickness of the buoy hull. The thickness of the buoy hull can be any thickness, such as about 1.0 in., about 0.5 in., about 0.375 in., about 0.25 in., about 0.1875 in., or about 0.125 in. in thickness. Accordingly, the thickness of exterior wall 102 can be in a range of about 0.9 in. to 0.0125 in., for example about 0.5 in., about 0.375 in., about 0.25 in., about 0.1875 in., about 0.125 in. or about 0.0625 in. in thickness.

The inventors conducted an experiment to learn where a buoy suffers the most corrosion.

A steel pipe with a thickness of 0.25 inches (representing a buoy) was placed within a closed incubator, heated to approximately 150° F., and kept in water with approximately 1.5 times the salinity of the Gulf of Mexico. A corrosion bath fan was also used to stir the water instead of allowing the "buoy" to sit in stagnant water. This allowed for a more real life scenario with waves constantly washing over the buoy hull. The steel pipe was then left in the incubator for two months. After collecting and analyzing the data, the accelerated corrosion experiment verified that the majority of corrosion on buoys occurs near the waterline with a majority of the corrosion occurring below the waterline. This supports the data and statements provided by various members of the Coast Guard who work at the buoy repair yards.

Due to the fact that the worst corrosion happens on either side of the waterline W, and because the compartment 100 is positioned at the waterline, and because the exterior wall 102 of compartment 100 is thinner than the rest of the buoy hull 112, any corrosion will penetrate through this section of the buoy before the rest of the buoy. Once corrosion penetrates through this section of the hull, water can enter into the hollow space contained within the compartment 100.

According to an embodiment, shown in FIG. 4, only the exterior wall 102 of compartment 100 is thinner, 0.125 in.; all other walls 104, 106, 108 are 0.25 inch thick. This means that when the water enters the space within the compartment, it will not compromise the watertight integrity of the rest of the buoy, nor will walls 104, 106, 108 corrode before the rest of the buoy hull.

According to various embodiments, compartment 100 contains a moisture detection system. In an embodiment, the moisture detection system includes a moisture sensor and/or a moisture activated switch. The technical details of such sensors and switches are commonly known in the art, but generally include a sensor in a circuit with a pair of spaced-apart terminals connected to a switch that closes in the presence of the liquid. In various embodiments, the switch operates by a change in the conductivity of a material between the terminals of the sensor or by expansion of a liquid absorber that pushes the two terminals together, or by a change in the conductivity of the space between the terminals as a result of the presence of the liquid.

According to various embodiments, the exterior wall 102 of compartment 100 fails before the rest of the buoy hull. Once the water penetrates into the compartment 100, the moisture detection system detects the water and signals that corrosion to the buoy hull has occurred.

In an embodiment illustrated in FIG. 4, the moisture detection system includes positive and negative leads 122 from a battery and two plates 124, 126, separated by a sponge material 128. When dry, the sponge material 128 will not conduct electricity and the circuit will remain open. Once wet, the circuit closes and current will flow, causing a relay to redirect current to a controller responsible for sending the signal.

In the embodiment shown in FIG. 4, the compartment 100 is installed in the buoy hull so that the exterior wall 102 is flush with the exterior of the buoy hull 112 and the inner walls 104, 106, 108 are inside of the buoy hull 112.

In alternative embodiments, shown in FIGS. 5A-5C, the compartment 100 is installed on the buoy so that much of the compartment 100 is outside of the buoy hull 112. In FIG. 5A, the buoy hull is cut and the compartment 100 is installed with exterior walls 102, 154 and 158 outside the hull 112, and interior wall 156 flush with the hull 112. In FIG. 5B, the compartment 100 is installed on the buoy hull 112, with interior wall 156 in contact with the hull 112, and with exterior walls 102, 154 and 158 outside the hull 112. In FIG. 5C, the compartment 100 is installed on the buoy hull 112 and is formed by the three exterior walls 102, 154 and 158, which are outside the hull.

According to various embodiments, such as those shown in FIGS. 5B and 5C, the compartment 100 is added to the buoy hull 112 without the need to cut an opening in the hull for the compartment. In these embodiments, the compartment 100 is merely attached or welded to the exterior of the buoy hull 112. In these embodiments, while the buoy hull 112 remains intact, the hull 112 has openings as needed for the passage of power leads (e.g., leads 122) and any other electronic, radio or signal wiring through the hull.

According to various embodiments, the compartment 100 has at least one exterior wall that touches the water, and that is adapted to corrode and fail prior to the rest of the buoy hull. In some embodiments, at least one exterior wall is thinner than the hull on the rest of the core. In various embodiments shown in FIG. 5A-5C, one or more of exterior walls 102, 154 and 158 are adapted to corrode and fail prior to the rest of the buoy hull 112.

Figure 6:
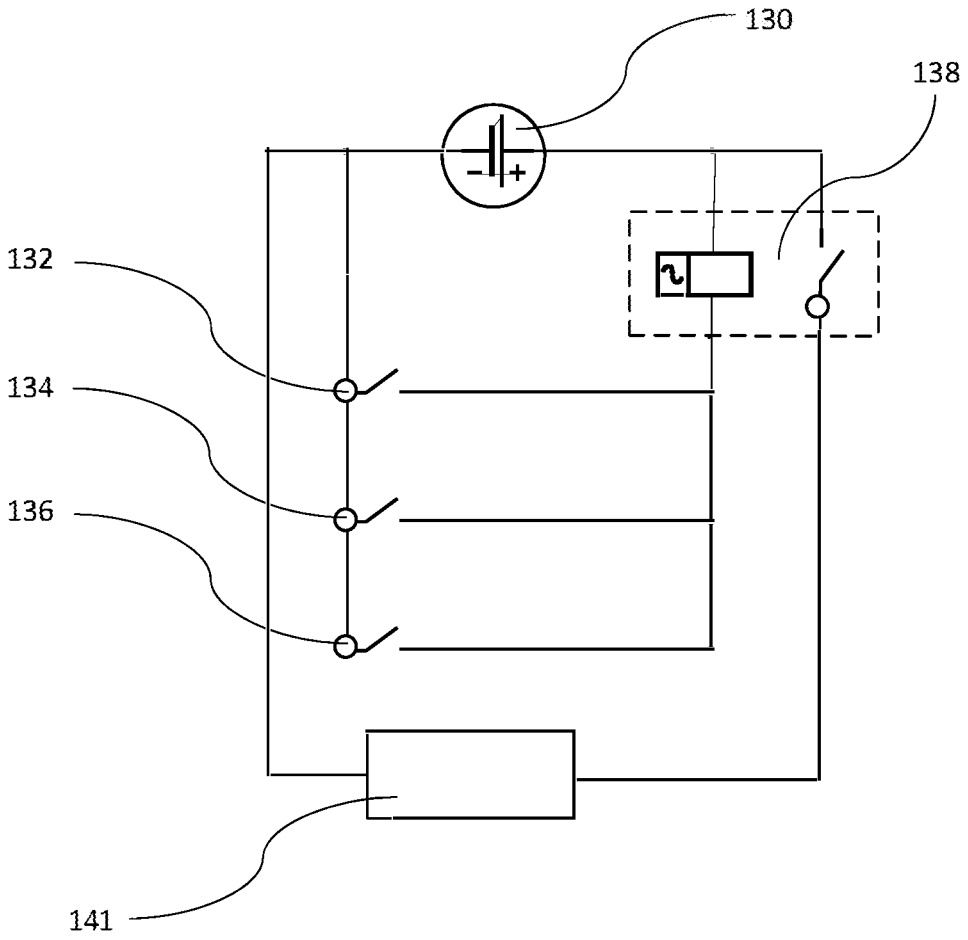
FIG. 6 is a schematic representation of a moisture detection system according to an embodiment of the present corrosion detection system.

According to various embodiments illustrated in FIG. 6, the moisture detection system includes more than one moisture activated switch 132, 134 and 136. In an embodiment, having more than one switch provides redundancy to the moisture detection system. In another embodiment, each switch is activated in series depending on the amount of water that has penetrated the exterior wall 102 of the compartment 100. Thus, for example, when water begins to penetrate at the first signs of corrosion, a first switch 132 is activated, sending current to a relay 138 and then to a signaling circuit 140. The signaling circuit 140 includes a controller that sends a signal that corrosion has started.

As the corrosion continues, and the amount of water penetrating the exterior wall 102 of the compartment 100 increases, a second switch 134 is activated, followed by a third switch 136, sending additional current to relay 138 and signaling circuit 140. The controller then sends a signal that corresponds to the amount of corrosion that has occurred.

According to various embodiments of the present corrosion detection system, the method of transmitting the corrosion information (i.e., the signal from the controller) incorporates the Global System for Mobile Communication (GSM) network. The GSM network has the range to reach the majority of the buoys the Coast Guard deploys. According to another embodiment, a satellite transmitter transmits the corrosion information. For instance, in an embodiment, when current flows through the signaling circuit a text message is sent stating, "Corrosion Detected." In some embodiments, this message also includes additional information such as the buoy number and location.

According to an embodiment of the present system, a lead-acid, rechargeable battery, such a Battery Mart 12V, 800 mA-hr battery, powers the system. This battery is capable of powering all required sensors and controllers, and is already being used to supply power to light and sound units of many currently deployed Coast Guard sea buoys. Despite its ability to be recharged, the battery is susceptible to a self-discharge rate of roughly 5% of current charge per month. This equates to about 40 mA-hr per month if the battery is fully charged. As the signal stating that corrosion has occurred may only be sent out once in the system's lifespan, the power-draw from the signaling circuit is about zero until it ultimately detects corrosion. Therefore, a power supply of about 40 mA*hr per month at 12V is required in order to sustain the readiness of the system. With the power maintained squarely at about 800 mA*hr, the system is poised to alert a designated Coast Guard buoy monitoring station with the corrosion alert warning.

Some embodiments include a solar charging unit for the battery onboard the buoy. In addition to, or in lieu of, the solar charging unit, various embodiments of the present corrosion detection system utilize the kinetic energy produced by the rolling motion of the buoy to recharge the battery. Some embodiments include a magnetic track designed to fit within the buoy to utilize the kinetic energy generated by the rolling motion.

By way of example, in one embodiment, the magnetic track is constructed out of PVC in a hexagonal design. A cylindrical N42 neodymium magnet is placed inside each leg of the track, and the outside of each leg is coiled with insulated 12 AWG wire. As the buoy oscillates back and forth, for example due to wave or current motion, the magnets housed inside the track slide along their respective paths. Through the use of Faraday's Law, the moving magnetic field produced by the magnets induces an electromotive force in the coiled wire. According to Faraday's Law, the electromotive force ($\varepsilon_{ind}$) is proportional to the number of coils (N), the cross sectional area (A) of the coils, and the strength of the magnetic field (B). Likewise the electromotive force ($\varepsilon_{ind}$) is inversely proportional to the time (t) it takes the magnetic field to pass through the set of coils as shown in Equation. 1.

$$\varepsilon_{ind} = N\frac{BA}{t} \qquad \text{Equation 1}$$

The alternating current is then converted to direct current and stored with the selected 12 Volt lead acid battery.

According to various embodiments, the magnetic track has a hexagon shape. Alternatively, the magnetic track has any of various shapes, including for example a triangle, a square, a hexagon, and an octagon. Various factors are considered in the shape, including how well each track optimizes waves from various directions, the number of coils that fit on the different track legs, the cost of each track, and ultimately how much energy each track produces.

Figure 7:
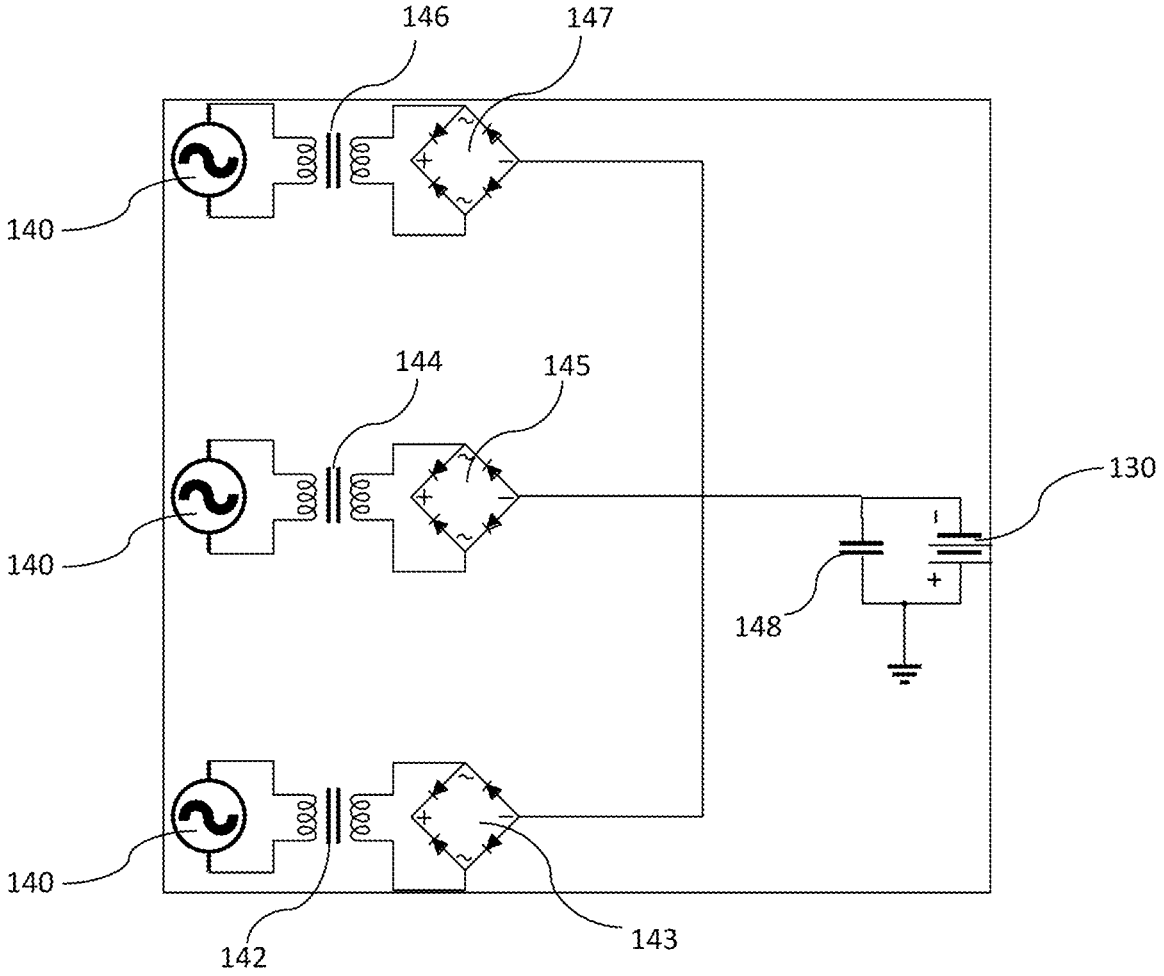
FIG. 7 is a schematic representation of a battery charging system according to an embodiment of the present corrosion detection system.

In some instances, such as when the water surrounding the buoy is relatively calm, the rolling motion of the buoy and the consequent kinetic energy may be low. In such instances, the magnetic track produces a positive and negative voltage peak that may not be sufficient to effectively charge the battery (for example, voltage peaks of about 0.5V and −0.5V). According to various embodiments, illustrated in FIG. 7, the battery charging system includes a charging circuit that steps up the voltage to 16 VAC, and converts it to DC. In an embodiment, the system uses one or more 32:1 step-up ratio transformers 142, 144 and 146 to step up the rolling motion generated voltage 141. One or more rectifier circuits 143, 145 and 147 then switch the negative voltage peak to positive voltage and convert the 16 VAC to DC. In an embodiment, full-wave rectifier circuits 143, 145, 147 include one or more diodes, such as four diodes.

After passing from the rectifier circuit, the rectified direct current passes across the battery 130 and a capacitor 148. The capacitor 148 acts as a filter and helps to smooth out the voltage levels experienced by the battery 130. In an embodiment, the capacitor has a capacitance of about 100 μF. Due to the frequency at which the voltage is oscillating, a larger capacitor may not have enough time to charge up to the full 16V before the voltage source falls back to zero and no charging occurs. The 100 μF capacitor charges up to the desired level and maintains the voltage across the battery above 12V between the two positive peaks. According to various embodiments, the rolling motion charging system generates excess power.

According to various embodiments, the buoy also has weather sensors such as humidity, barometric pressure, and temperature sensors, and/or a GPS unit to indicate if the buoy is off station following a storm or collision. In embodiments, the buoy has an anemometer and/or a current-measuring device.

In an embodiment, the buoy sends the weather and/or GPS data regularly or on a set schedule. In other embodiments, the buoy sends the weather and/or GPS data only when requested by a land-based control center. In some embodiments, the buoy sends the data using the signaling equipment in conjunction with the present corrosion monitoring system. When requested, the buoy takes the GPS position, hour, minute, second, temperature, humidity and pressure measurements and relays the information back to the requesting station. This allows the user to determine the conditions in the vicinity of the buoy.

Another aspect of the present disclosure relates to a method of detecting corrosion in a buoy. According to various embodiments, the method autonomously detects and monitors corrosion levels, such as oxidation and/or coating failure, in a buoy hull. Embodiments of the method support a buoy maintenance schedule performed "as needed".

According to various embodiments of the method, a buoy is provided having a a double hull section in the buoy positioned at the waterline. The double hull section has an outer hull and an inner hull. The outer hull is adapted to corrode and fail prior to the rest of the buoy hull. When the outer hull of the double hull section corrodes enough to permit water to enter, the water enters a small compartment. Detection equipment in the compartment detects the water and communicates that corrosion has occurred.

In various embodiments, the compartment contains a moisture detector in communication with a signaling circuit configured to send a signal that corrosion has occurred. The buoy is deployed in a body of water, such as an ocean, a sea, a river, a lake, a harbor or a marina.

Over time, as the buoy corrodes, water will begin to enter through the outer hull or exterior wall of the double hull section. The moisture detector detects the water entering through the exterior wall of the outer hull and relays a signal to the signaling circuit that corrosion has occurred. The signaling circuit then sends a communication to a user that the buoy has corrosion. Because the outer hull of the double hull section is designed to corrode and fail before the rest of the hull, corrosion to the buoy can be detected early, before a larger amount of corrosion to the buoy has occurred. This allows the buoy to be serviced early before being degraded beyond the ability to repair. Alternatively, if no corrosion is detected, the buoy can remain in deployment instead of being unnecessarily hoisted from the water and transported back to a repair facility.

According to various embodiments, the outer hull of the double hull section is thinner than the rest of the hull, the lower thickness providing a means for earlier corrosion and failure prior than the rest of the hull. The double hull section is centered on the buoy at the waterline because this is the area most prone to corrosion.

According to various embodiments, the corrosion detection method also includes powering the moisture detector and signaling system with a battery. In embodiments, the battery is charged and/or recharged with a regenerative energy system. Embodiments of the regenerative energy system include the use of solar panels and/or the rolling motion of the buoy.

According to various embodiments of the present method, the signaling circuit communicates the presence or absence of corrosion through a Global System for Mobile Communication (GSM) network. In some embodiments, the signaling circuit communicates through a satellite transmitter. In various embodiments, the signaling circuit communicates on a set schedule, such as daily, weekly or monthly, or in other embodiments, the signaling circuit communicates only when requested by a control center, such as a land-based control center.

Various embodiments incorporate the present corrosion detection method into any size or type of buoy.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Although terms such as "first" and "second" may be used herein to describe various features these features should not be limited by these terms, unless the context indicates otherwise. These terms may be used to distinguish one feature from another feature. Thus, a first feature discussed herein could be termed a second feature, and similarly, a second feature discussed below could be termed a first feature without departing from the teachings of the present invention.

Although various illustrative embodiments are described above, any of a number of changes may be made to various embodiments without departing from the scope of the invention as described by the claims. Optional features of various device and system embodiments may be included in some embodiments and not in others. Further, the particular features, structures or characteristics may be combined in any suitable manner in one or more embodiments. Therefore, the foregoing description is provided primarily for exemplary purposes and should not be interpreted to limit the scope of the invention as it is set forth in the claims.

What is claimed is:

1. A buoy, comprising:

a generally hollow core having a hull;

a section of the core having a double hull, the double hull section positioned on the buoy at a waterline area, the double hull section comprising an inner hull and an outer hull, the outer hull comprising at least one exterior wall;

a compartment enclosed by the inner hull and outer hull;

a moisture detector in the compartment; and a signaling circuit in communication with the moisture detector, configured to send a signal that corrosion has occurred, wherein the at least one exterior wall of the outer hull is adapted to corrode and fail prior to the rest of the hull.

2. The buoy of claim 1, wherein the exterior wall of the outer hull has a thickness that is lower than the rest of the hull.

3. The buoy of claim 1, wherein the double hull section is centered at the waterline.

4. The buoy of claim 1, further comprising a battery that powers the moisture detector and signaling circuit, and a regenerative energy system to charge the battery.

5. The buoy of claim 4, wherein the regenerative energy system utilizes kinetic energy generated by rolling motion of the buoy to charge the battery.

6. The buoy of claim 1, wherein the signaling circuit is configured to send the signal by a Global System for Mobile Communication network or by a satellite transmitter.

7. The buoy of claim 1, wherein the exterior wall of the outer hull is flush with the buoy hull, and the compartment is inside the buoy hull.

8. The buoy of claim 1, wherein the compartment is installed on the buoy hull and is outside the buoy hull.

9. The buoy of claim 1, wherein the exterior wall of the outer hull has a thickness that is 0.9 to 0.1 times the thickness of the rest of the hull.

10. The buoy of claim 1, wherein the moisture detector comprises a plurality of moisture activated switches.

11. A method of detecting corrosion in a buoy, comprising:

providing a buoy comprising a generally hollow core having a hull;

a section of the core having a double hull, the double hull section positioned on the buoy at a waterline area, the double hull section comprising an inner hull and an outer hull, the outer hull comprising at least one exterior wall;

a compartment enclosed by the inner hull and outer hull;

a moisture detector in the compartment; and a signaling circuit in communication with the moisture detector, configured to send a signal that corrosion has occurred, wherein the at least one exterior wall of the outer hull is adapted to corrode and fail prior to the rest of the hull;

deploying the buoy in a body of water;

detecting water entering the compartment through the exterior wall of the outer hull with the moisture detector;

relaying a signal from the moisture detector to the signaling circuit that water has entered the compartment, the water indicating the presence of corrosion; and sending a communication to a user that the buoy has corrosion.

12. The method of claim 11, wherein the at least one exterior wall of the outer hull has a thickness that is lower than the rest of the hull.

13. The method of claim 11, wherein the double hull section is centered at the waterline when the buoy is deployed.

14. The method of claim 11, further comprising powering the moisture detector and the signaling circuit with a battery, and charging the battery with a regenerative energy system.

15. The method of claim 14, wherein the regenerative energy system utilizes kinetic energy generated by rolling motion of the buoy.

16. The method of claim 11, wherein the communication is sent by a Global System for Mobile Communication network or by a satellite transmitter.

17. The method of claim 11, wherein the communication is sent only when requested by a control center.

* * * * *